United States Patent [19]

Bennett et al.

[11] Patent Number: 4,880,954

[45] Date of Patent: Nov. 14, 1989

[54] COMBINED REFRIGERATOR AND MICROWAVE OVEN WITH TIMED OVERLOAD PROTECTION

[76] Inventors: Robert P. Bennett, 49 Francis Wyman Rd., Burlington, Mass. 01803; Kunimitsu Ozaki, 721 Mikan Dr., Richmond, Ind. 47374

[21] Appl. No.: 201,903

[22] Filed: Jun. 3, 1988

[51] Int. Cl.[4] ..... H05B 6/68

[52] U.S. Cl. ..... 219/10.55 M; 219/10.55 B; 219/10.55 R; 221/150 HC; 307/41; 307/30; 361/22

[58] Field of Search ..... 219/10.55 B, 10.55 R, 219/10.55 E, 10.55 C, 10.55 M, 10.55 D, 485, 486; 307/38, 41, 35, 30; 221/150 HC; 361/22, 31, 195

[56] References Cited

U.S. PATENT DOCUMENTS

| | | | |
|---|---|---|---|
| T973,013 | 8/1978 | Ferrara et al. | 219/10.55 E X |
| 3,482,509 | 12/1969 | Gardner | 219/10.55 R |
| 4,004,712 | 1/1977 | Pond | 219/10.55 B |
| 4,045,640 | 8/1977 | McQueen, Jr. et al. | 219/10.55 B |
| 4,068,781 | 1/1978 | Toth | 219/485 |
| 4,129,769 | 12/1978 | Takagi et al. | 219/10.55 B |
| 4,225,204 | 9/1980 | Bellavoine | 219/386 |
| 4,227,062 | 10/1980 | Payne et al. | 219/10.55 B |
| 4,398,651 | 8/1983 | Kumpfer | 219/10.55 B |
| 4,592,485 | 6/1986 | Anderson et al. | 221/150 HC |

*Primary Examiner*—Philip H. Leung

*Attorney, Agent, or Firm*—Morris Fidelman; Franklin D. Wolffe

[57] ABSTRACT

A microwave oven and a refrigerator are combined in a single cabinet and share line power supplied to the cabinet. Door interlocks and a manually settable time are provided for disconnecting electrical supply to the compressor of the refrigerator during operation of the magnetron of the microwave oven. The circuitry provided ensures that electrical supply is reconnected to the compressor upon expiration of the timer setting, even if the door of the oven is incidentally left open after use.

3 Claims, 2 Drawing Sheets

PRIOR ART

COMBINED REFRIGERATOR AND MICROWAVE OVEN WITH TIMED OVERLOAD PROTECTION

PRIOR ART CROSS REFERENCES

U.S. Pat. No. 3,482,509 Gardner, SANDWICH COOKING AND DISPENSING MACHINE, issued Dec. 9, 1969.

U.S. Pat. No. 4,225,204—Bellavoine, CUPBOARD FOR STORING PREPARED MEALS, WITH COLD-STORAGE AND REHEATING BY MICROWAVES, issued Sept. 30, 1980.

U.S. Pat. 4,398,651 Kumpfer, MICROWAVE FOOD DISPENSING MACHINE, issued Aug. 16, 1983.

U.S. Pat. No. 4,592,485—Anderson, et al, MEAL VENDING APPARATUS, issued June 3, 1986.

U.S. application Ser. No. 097,680—Bennett, REFRIGERATOR AND MICROWAVE OVEN AND OVERDEMAND INTERRUPT CIRCUIT, filed Sept. 17, 1987.

BACKGROUND OF THE INVENTION

This invention relates to a refrigerator and microwave oven enclosed in the same cabinet with unique electrical circuitry, so as to provide the convenience of storing and cooking food simultaneously in the same unit, while avoiding the peak power demands of simultaneous operation of the refrigerator compressor and the microwave magnetron. The invention finds particular application in buildings having older wiring and fewer circuits, by minimizing the possibilities of overloading such circuits while providing safe uninterrupted service. It also prevents overloading a more modern circuit which is "dedicated" to the apparatus by preventing start-up of the compressor during operation of the magnetron.

Microwave ovens are now commonly available in quick stop grocery stores and lunch rooms for heating and cooking foodstuffs purchased across the counter and from vending machines. Prior to the above-referenced Bennett application though, it had not been proposed to combine a microwave oven and refrigerator on a smaller scale in the same cabinet, particularly with provision for limiting the peak instantaneous power consumption so as to make the combination useful and attractive for use by students in dorm rooms, resort hotel rooms, tractor trailer cabs, recreational vehicles, so-called pullman efficiencies and the like.

The remaining prior art teaches refrigerated storage and a microwave oven combined in the same vending machine cabinet, and provision for transporting a selected item to the microwave oven for heating and subsequent removal from the machine. In particular, U.S. Pat. No. 4,398,651 discloses a switch, associated with a stack of food containers and actuated upon insertion of the uppermost container from the stack into a microwave oven, which causes a motor to drive a screw which, in turn, raises the stack until the next uppermost container changes the state of the switch. The amount of time that it takes for the switch to be changed by the raising stack determines the time of de-energization of a relay 56 which, in turn, determines how long the refrigerator is off and the microwave oven is on.

It is among the objects of the instant invention to combine prior art appliances into a single more convenient apparatus by utilizing a single molded, insulated shell containing both a microwave oven and a refrigerator, while at the same time providing adequate ventilation of both and limiting instantaneous peak power consumption by the combination.

SUMMARY OF THE INVENTION

A microwave oven and a refrigerator are combined in a single cabinet and share line power supplied to the cabinet. Door interlocks and a manually settable time are provided for disconnecting electrical supply to the compressor of the refrigerator during operation of the magnetron of the microwave oven. The circuitry provided ensures that electrical supply is reconnected to the compressor upon expiration of the timer setting, even if the door of the oven is incidentally left open after use.

DETAILED DESCRIPTION OF THE INVENTION

Figure 1:
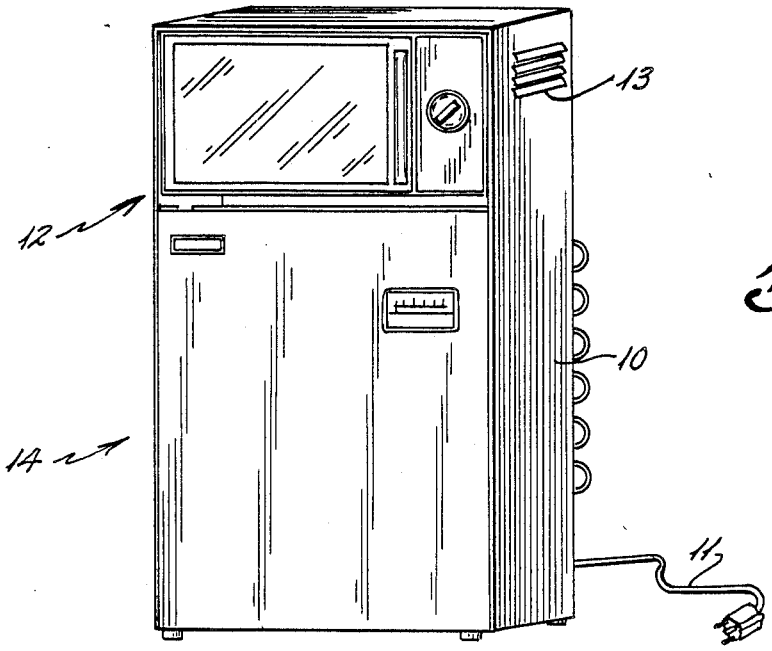
FIG. 1 is an isometric view of a microwave oven and refrigerator sharing a common housing.

Referring to the drawings, cabinet 10 houses a microwave oven upper section 12 and a refrigerator lower section 14, with louvers 13 for venting the microwave section and cord 11 for supplying power to the combined refrigerator and microwave device from the standard receptacle.

The basic housing 10 comprises molded inner and outer shells with appropriate insulation therebetween, and these shells may be comprised of several panels defining sides, top, bottom, front and back of the device. The construction of the refrigerator section generally is well known and includes a freezer compartment. Below or at the rear of the refrigerated compartment and above the bottom panel is a refrigeration unit including condenser coils (not shown), while heat transfer mesh or screen is attached at the rear of the unit.

Above refrigerator section 14, and thermally insulated therefrom, is the microwave oven section 12 having the cooking compartment thereof surrounded by an absorptive layer. The absorptive layer is for preventing microwave energy from (1) reflecting from the outer wall and back to the magnetron of the microwave oven and thus damaging the magnetron, (2) warming foodstuffs in adjacent refrigerator compartments, and (3) escaping from the unit to the surrounding environment.

Of particular importance in the invention is the provision of a timing circuit 30 for controlling power to the magnetron and the compressor of the refrigerator.

Figure 3:
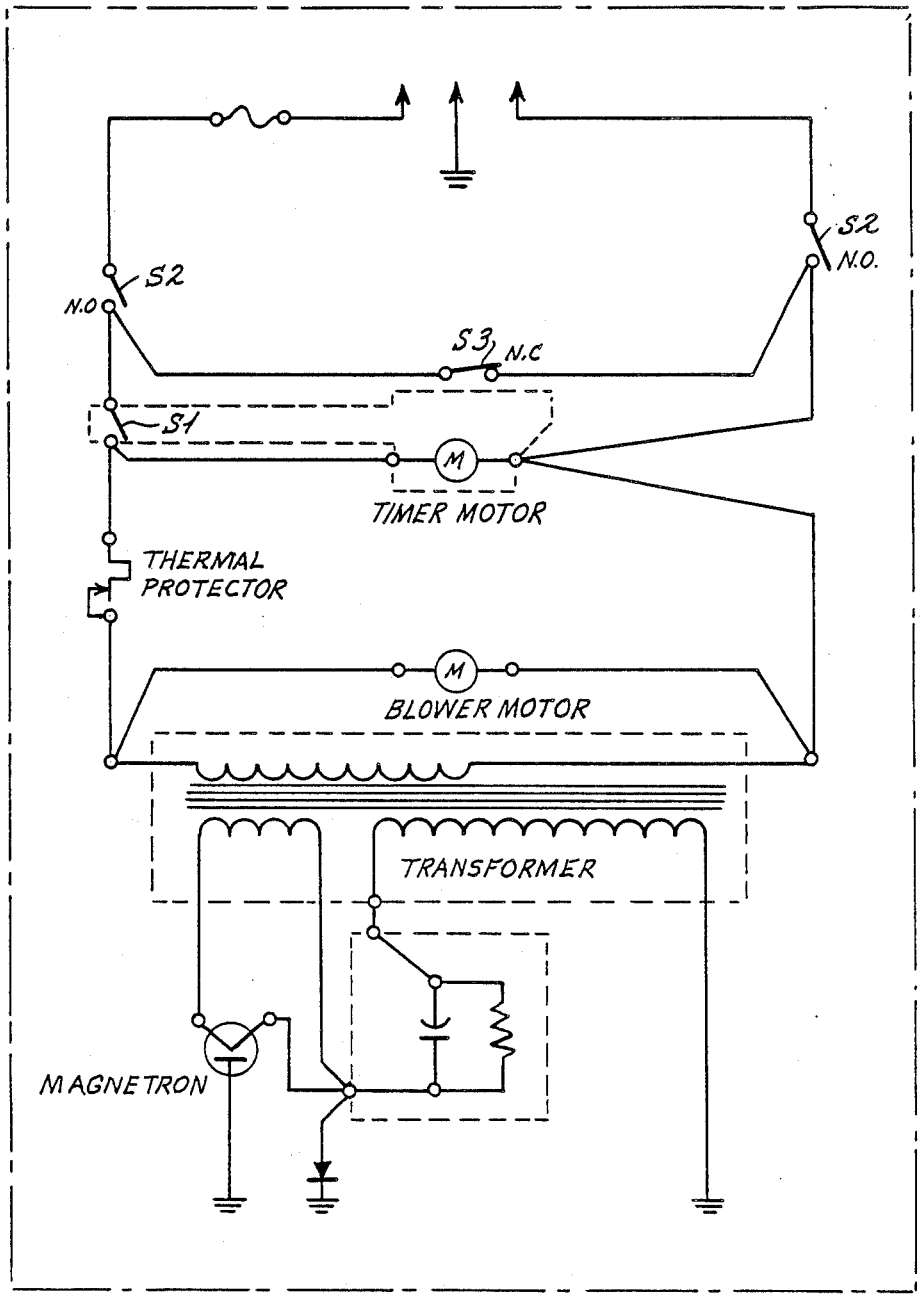
FIG. 3 is a schematic circuit diagram of a conventional microwave oven.

Referring to FIG. 3, the magnetron of a conventional microwave is supplied with power via a transformer. In FIG. 3, the door of the oven is open and, upon closing thereof, the interlock switches S2 are closed and switch S3 is opened. Thus, the door must be closed in order for line power to be supplied to the timer switch S1 and to the transformer.

However, in order to combine a microwave oven and refrigerator in the same cabinet, while sharing line power supplied to the cabinet in the least costly and most efficient manner, it is necessary to ensure that the magnetron of the oven and the compressor of the refrigerator are not operated at the same time.

Figure 2:
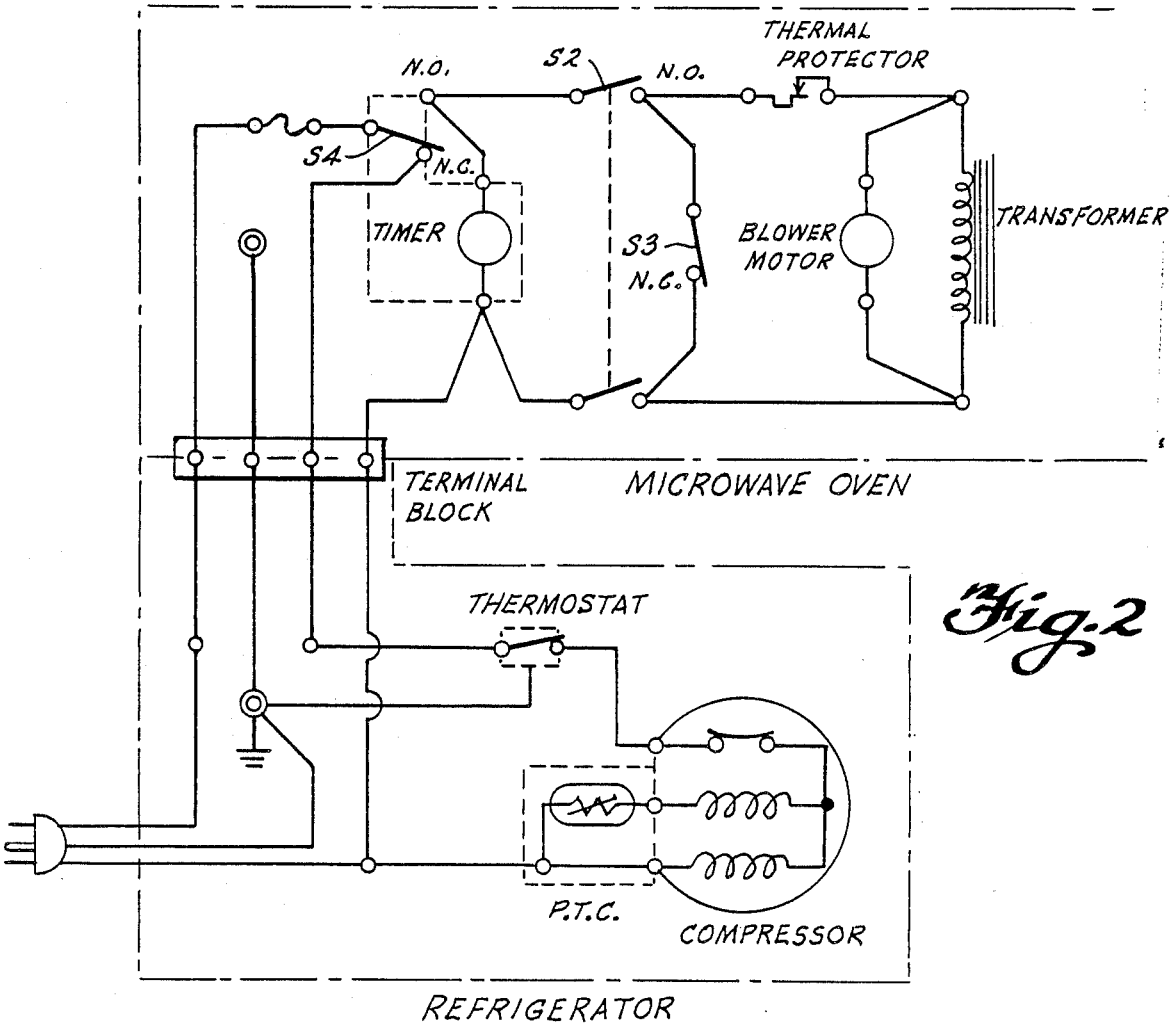
FIG. 2 is a schematic diagram illustrating an electrical circuit providing features of the instant invention.

As seen in FIG. 2, the instant invention provides that the manually settable timer of a microwave oven interrupts line power to the refrigerator compressor by means of switch S4 whenever the timer is operating, while providing that same line power to the microwave oven and magnetron thereof in a manner that ensures the availability of line power to the refrigerator compressor upon completion of the timing function, even if the door of the microwave has been left open. In other words, with the timer manually set and actuated so that power is supplied to the timer motor via switch 54 according to a desired cooking time by the microwave oven, and with the door of the oven closed so that the interlock switches S2 and S3 allow supply of line power to the transformer of the microwave, opening the door of the prior to completion of the timing function will open switches S2 and interrupt power to the magnetron, but not to the timer. Thus, if the door is left open, line power can again be supplied to the compressor via switch S4 at the end of the previously selected timing period.

Having described the invention, it will be seen that the objects set forth above, among those made apparent from the preceding description, are efficiently obtained and, since certain changes may be made in carrying out the above method and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention hereindescribed, and all statements of the scope of the invention which, as a matter of language, might be said to fall therebetween.

Now that the invention has been described, I claim:

1. In a method of operating a compressor of a refrigerator and a magnetron of a microwave oven, said refrigerator and microwave oven being combined in a single cabinet, the improvement comprising the steps of:

providing said microwave oven with manually settable means for timing supply of operating power to said magnetron for different, selectable periods of time;

setting said timing means according to each desired period of operation of said magnetron;

starting and operating said timing means according to said setting; and preventing operation of said refrigerator compressor by and during said operating of said timing means.

2. In an electrical supply control circuit for a compressor of a refrigerator and a magnetron of a microwave oven, said refrigerator and microwave oven being combined in a single cabinet and sharing line power supplied to said cabinet, the improvement comprising:

manually settable means for timing supply of operating power to said magnetron for different, selectable periods of time; and means for interrupting a power path to said refrigerator compressor during said operating of said timing means.

3. In an electrical supply control circuit for a compressor of a refrigerator and a magnetrom of a microwave oven, said refrigerator and microwave oven being combined in a single cabinet and sharing line power supplied to said cabinet, said microwave oven being provided with a door having interlock means for interrupting power to said magnetron when said door is open, the improvement comprising:

manually settable means for timing supply of operating power to said magnetron for different, selectable periods of time;

means for interrupting a power path to said refrigerator compressor during said operating of said timing means; and circuitry means for reestablishing said power path upon cessation of said timing means even when said door is open.

* * * * *